US008966949B2

(12) United States Patent
Habecke

(10) Patent No.: US 8,966,949 B2
(45) Date of Patent: Mar. 3, 2015

(54) LOCKING DEVICE

(75) Inventor: Matthias Habecke, Hattingen (DE)

(73) Assignee: Huf Hulsbeck & Furst GmbH & Co. KG (DE)

( * ) Notice: Subject to any disclaimer, the term of this patent is extended or adjusted under 35 U.S.C. 154(b) by 0 days.

(21) Appl. No.: 13/578,182

(22) PCT Filed: Feb. 4, 2011

(86) PCT No.: PCT/EP2011/051637

§ 371 (c)(1),
(2), (4) Date: Sep. 4, 2012

(87) PCT Pub. No.: WO2011/098405

PCT Pub. Date: Aug. 18, 2011

(65) Prior Publication Data

US 2013/0000368 A1 Jan. 3, 2013

(30) Foreign Application Priority Data

Feb. 10, 2010 (DE) ..... 10 2010 001 790

(51) Int. Cl.
*E05B 27/00* (2006.01)
*E05B 19/00* (2006.01)
*E05B 29/00* (2006.01)

(52) U.S. Cl.
CPC ..... *E05B 19/0017* (2013.01); *E05B 29/00* (2013.01)
USPC ..... 70/492; 70/358; 70/409

(58) Field of Classification Search
USPC ..... 70/356, 358, 492, 405–407, 409
See application file for complete search history.

(56) References Cited

U.S. PATENT DOCUMENTS

| | | | | |
|---|---|---|---|---|
| 4,377,082 | A * | 3/1983 | Wolter | 70/493 |
| 4,516,416 | A * | 5/1985 | Prunbauer et al. | 70/276 |
| 4,612,787 | A * | 9/1986 | Prunbauer et al. | 70/358 |
| 4,644,768 | A * | 2/1987 | Nowak et al. | 70/492 |
| 4,756,177 | A * | 7/1988 | Widen | 70/493 |
| 7,337,639 | B2 * | 3/2008 | Edwards, Jr. | 70/409 |
| 8,261,588 | B2 * | 9/2012 | Šabata | 70/492 |

(Continued)

FOREIGN PATENT DOCUMENTS

| | | |
|---|---|---|
| AT | 396501 B | 10/1993 |
| DE | 1297922 | 6/1969 |

(Continued)

OTHER PUBLICATIONS

International Search Report; International Application No. PCT/EP2011/051637; International Application Filing date Feb. 4, 2011; Mail Date Jun. 8, 2011.

(Continued)

*Primary Examiner* — Suzanne Barrett
(74) *Attorney, Agent, or Firm* — Cantor Colburn LLP

(57) ABSTRACT

The invention relates to a locking device of a motor vehicle, having a key (10) and a lock cylinder, wherein the lock cylinder comprises a cylinder core rotatably supported in a cylinder housing of the lock cylinder, a channel comprising the cylinder core and into which the key (10) can be inserted, spring-loaded tumbler elements displaceably supported radial to the cylinder axis of the lock cylinder when inserting the key (10) into the channel radial to the cylinder axis of the lock cylinder, the plurality of outer surfaces (11*a*, 11*b*, 12*a*, 12*b*) on the key (10) comprising at least two encoding strips (51*a*, 51*b*) acting on the tumbler elements when the key (10) is inserted.

16 Claims, 7 Drawing Sheets

(56) References Cited

U.S. PATENT DOCUMENTS

| | | | | |
|---|---|---|---|---|
| 8,327,675 | B2 * | 12/2012 | Baumann | 70/494 |
| 8,726,706 | B2 * | 5/2014 | Jacob | 70/409 |
| 2004/0237614 | A1 * | 12/2004 | Ketzler et al. | 70/493 |
| 2008/0196461 | A1 * | 8/2008 | Widen | 70/409 |
| 2008/0236223 | A1 * | 10/2008 | Markbreit et al. | 70/358 |
| 2009/0025442 | A1 * | 1/2009 | Klein et al. | 70/492 |
| 2009/0266123 | A1 * | 10/2009 | Mueller et al. | 70/348 |
| 2011/0041575 | A1 * | 2/2011 | Habecke | 70/357 |
| 2011/0302972 | A1 * | 12/2011 | Higuchi | 70/491 |
| 2012/0073340 | A1 * | 3/2012 | Widen | 70/495 |
| 2012/0240645 | A1 * | 9/2012 | Mathachan | 70/491 |
| 2012/0279265 | A1 * | 11/2012 | Winkler et al. | 70/358 |

FOREIGN PATENT DOCUMENTS

| | | | |
|---|---|---|---|
| EP | 0712979 | A1 | 5/1996 |
| EP | 0989262 | A2 | 3/2000 |
| EP | 1055788 | A2 | 11/2000 |
| FR | 2551794 | A1 | 3/1985 |
| JP | 5311283 | U | 3/1977 |
| JP | 2000501803 | A | 2/2000 |
| JP | 2001323693 | A | 11/2001 |
| JP | 2006144422 | A | 6/2006 |
| JP | 2007239265 | A | 9/2007 |
| JP | 2008144433 | A | 6/2008 |
| JP | 2000230357 | A | 6/2009 |

OTHER PUBLICATIONS

Japanese Office Action issued Aug. 12, 2014 re: Japanese Application No. 2012-552349; citing: JP53-119283, JP2001-323693, JP2000-501803, JP2007-239265, JP2006-144422, JP2008-144433 and JP2000-230357.

* cited by examiner

LOCKING DEVICE

TECHNICAL FIELD

The invention relates to a lock device of a motor vehicle, having a key and a lock cylinder, wherein the lock cylinder has a cylinder core which is rotatably mounted in a cylinder housing of the lock cylinder, having a channel which comprises the cylinder core and into which the key can be inserted, and having spring-loaded locking elements which are mounted to be able to slide radially with respect to the cylinder axis of the lock cylinder upon the insertion of the key into the channel.

BACKGROUND

It has been shown to be a disadvantage that unauthorized persons attempting to steal a motor vehicle try to order the locking elements in the key channel along the cross-section of the cylinder core, using break-in tools, for example by means of so-called "picking" of the locking elements, whereby the same then allow the cylinder core to rotate.

It has been shown that less constructed space is required for such lock devices in some cases, but at the same time it is necessary to ensure a high level of break-in security of the lock device.

BRIEF SUMMARY

According to the invention, a lock device of a motor vehicle has a key and a key cylinder, wherein the key cylinder has a cylinder core which is rotatably mounted in a cylinder housing of the lock cylinder, has a channel which comprises the cylinder core and into which the key can be inserted, has spring-loaded locking elements which are mounted to be able to slide radially with respect to the cylinder axis upon the insertion of the key into the channel, and has multiple outer surfaces included on the key which have at least two coding tracks which act on the locking elements upon the insertion of the key. One of the essential advantages of this lock device according to the invention is that, due to the at least two coding tracks, the same included on one outer surface of the key, whereby it is possible to create a compact lock cylinder and at the same time a large number of code combinations is possible.

Likewise, the outer surfaces can have two narrow sides, particularly a first and second narrow side, and two wide sides, particularly a first and a second wide side. In this case it can also be contemplated that the key is a four-sided flat profile which has pairs of narrow sides and pairs of wide sides each lying opposite each other. For example, a rectangular profile can be contemplated. Likewise, it can be possible that the profile is constructed as a square, such that the narrow side and the wide side can be constructed with the same surface size.

In one possible embodiment of the invention, the key can be designed as a reversible key, such that the key can assume at least two positions in which the key can be effectively inserted into the channel. This means that the key has a profiling, with respect to its coding tracks, which enables the user to orient the key in different ways, and therefore to functionally insert the same in different positions into the key channel. The key can advantageously have two different positions which are oriented at a rotation of 180° with respect to each other, in order to insert the key effectively into the locking cylinder. It has been shown that the number of code combinations is reduced when a reversible key is used, and the convenience for the user is improved at the same time.

In this case, the coding tracks according to the invention serve the purpose of coding, wherein the coding tracks are constructed with such a profiling that they correspond to the locking elements of the lock cylinder. This means that only the key with the corresponding "correct" code track and/or coding track results in a corresponding sliding of the locking elements out of the key channel in order to move the cylinder core inside the cylinder housing when the key is inserted.

In one possible embodiment, the key can have only two coding tracks, wherein the first narrow side is designed with a first coding track and the second narrow side is designed with a second coding track. It can likewise be contemplated that the first wide side is designed with a first coding track and the second wide side is designed with a second coding track. As an alternative, it can be contemplated that a first narrow side is designed with a first coding track and one wide side is designed with a second coding track. In one possible embodiment of the invention, the coding tracks are designed as having different geometries from each other, such that in this case the key is not a reversible key. In this way, it is possible to achieve a large number of lock combinations. As such, it is possible at the same time to achieve a reduced cross-section of the key, along with a small opening to the key channel of the cylinder. Due to the small insertion opening for the key, it has been shown as advantageous that it is not possible to willfully apply high forces into the cylinder core for the purpose of the manipulation thereof. In addition, due to the small channel opening for the key, the configuration achieves an improved seal effect for the lock cylinder. In addition, it has been shown as advantageous that a large number of locking elements is possible with the same constructed length of the lock cylinder.

For example, 8 to 20 locking elements can be used. The large number of the locking elements enables, among other things, a greater torque. An additional advantage is that the resistance to an unauthorized "picking" is increased.

With regard to the possible embodiment of a key having two coding tracks, two outer surfaces are always free of a coding track. This means that one wide side and one narrow side can be constructed solid, without a coding track arranged on these sides. As an alternative, both wide sides or both narrow sides can be constructed without coding tracks. The key is for practical purposes a solid object, wherein the coding track is milled into the same. By means of the measure of including a narrow side with no coding track, it is possible to further reduce the height of the key. Because of the resulting possible size reduction of the key channel, the lock cylinder is also more secure against break-in, because with every reduction in size, a potential break-in tool must likewise become smaller in order to still be inserted into the key channel, and the maximum force which can be exerted is also reduced.

It can likewise be contemplated that the outer surfaces of the key have three coding tracks. In this case, it is possible, for example, that both wide sides are each designed with one coding track, and only one narrow side has a corresponding coding track. As an alternative, it can likewise be reasonable for both narrow sides to each be designed with one coding track, wherein one narrow side has only one coding track. The narrow side opposite thereto is at the same time designed with no coding track. Because of the three coding tracks, it is simultaneously possible to substantially increase the number of the code combinations of this lock device according to the invention. At the same time, the cross-section of the key, the functional length of the key, and the constructed length of the locking cylinder can be reduced. In addition to the low production costs, it is therefore also possible at the same time to achieve increased security against potential manipulations of the locking cylinder.

In a further possible measure implemented by the invention, the outer surface of the key can have four coding tracks. In this embodiment, each outer surface of the key has one coding track.

Four coding tracks result in a further increase in the number of possible code combinations, whereby the constructed length of the lock cylinder, the cross-section of the key, and the functional length of the key can be significantly reduced.

One possible embodiment of the invention is that the coding track can be designed as a groove and/or as a ridge. In this case, the groove or the ridge can particularly have a track width which is substantially consistent. The groove in this case is designed as a recess on the outer surface of the key, wherein the associated locking elements engage therein upon the insertion of the key. In contrast, the ridge is designed in the manner of a projection on the outer surface of the key, wherein each respective locking element engages therein upon the insertion of the key. The key, having two coding tracks, three coding tracks or four coding tracks, can be designed in such a manner that only coding tracks designed as a groove, coding tracks designed as a ridge, or coding tracks designed as a groove and a ridge are used.

The coding track advantageously has at least one guide surface which acts on associated locking elements, particularly such that the first coding track acts on the first locking element and the second coding track acts on the second locking element, wherein particularly a sliding of the first locking element takes place in a first radial direction with respect to the cylinder axis, and a sliding of the second locking element takes place in a second radial direction with respect to the cylinder axis, perpendicular to the first radial direction.

In a further embodiment, the first locking elements and the second locking elements can be arranged in the cylinder core in an alternating sequence. In this way, an increased security against potential manipulations from the exterior is achieved, because the first locking elements must be displaced by the manipulation tool in a first direction, and the second locking element must be displaced in a second direction in order to order the locking elements in an unauthorized manner, to then allow a rotation of the cylinder core.

A further advantage of the invention can be that the first locking elements comprise a plurality of individual locking elements which are each spring-loaded in different directions. In addition, the second locking elements can comprise a plurality of individual locking elements which are likewise each spring-loaded in different directions. For example, a spring acts on each individual locking element. In this case, the first locking elements work with at least one coding track of one of the two wide sides. The second locking elements can work together with at least one coding track of one of the narrow sides. In order to further increase security against a break-in, at this point the direction of the spring-loading on the individual locking elements of the first locking elements can be oriented differently among the individual locking elements. As such, the manipulator must move the first individual locking element of the first locking elements in a defined direction, for example, using the manipulation tool, wherein the following two individual locking elements of the first locking elements must be ordered in an opposite direction, for example, and consequently moved in that direction. The spring-loading applied in different directions can of course be used on the second locking elements. As such, it is possible to achieve an increased resistance to the use of manipulation tools, with a simultaneously small opening to the key channel.

In one possible embodiment of the invention, at least one narrow side has a ridge as the coding track, and at least one wide side has a groove as the coding track.

In one measure which improves the invention, the key can have at least one auxiliary coding track which is included on the narrow side and/or on the wide side, and which particularly rules out a reversible function of the key. For example, the auxiliary coding track can have an extension on one of the outer surfaces of the key which is realized without a change in direction. This means that the auxiliary coding track runs parallel to the cylinder axis, for example. The cross-section of the auxiliary coding track can have different geometric shapes. For example, the auxiliary coding track can be designed as a groove which can take its geometric shape as round, rectangular, or oval. The purpose of an auxiliary coding track on the key can further be, for example, that a key system is used which has a primary key which is designed with such an auxiliary coding track. An additional secondary key can have the identical coding tracks on the outer surfaces of the key, but is nevertheless designed without such an auxiliary coding track, such that this secondary key is only effective for the user in a limited capacity and only can be inserted into prespecified lock cylinders.

BRIEF DESCRIPTION OF THE DRAWINGS

Additional features and advantages as well as technical features of the invention are set forth in the claims, in the following description, and in the illustrations. In the following figures, lock devices according to the invention are illustrated in detail in multiple embodiments, wherein:

DETAILED DESCRIPTION

Figure 1:
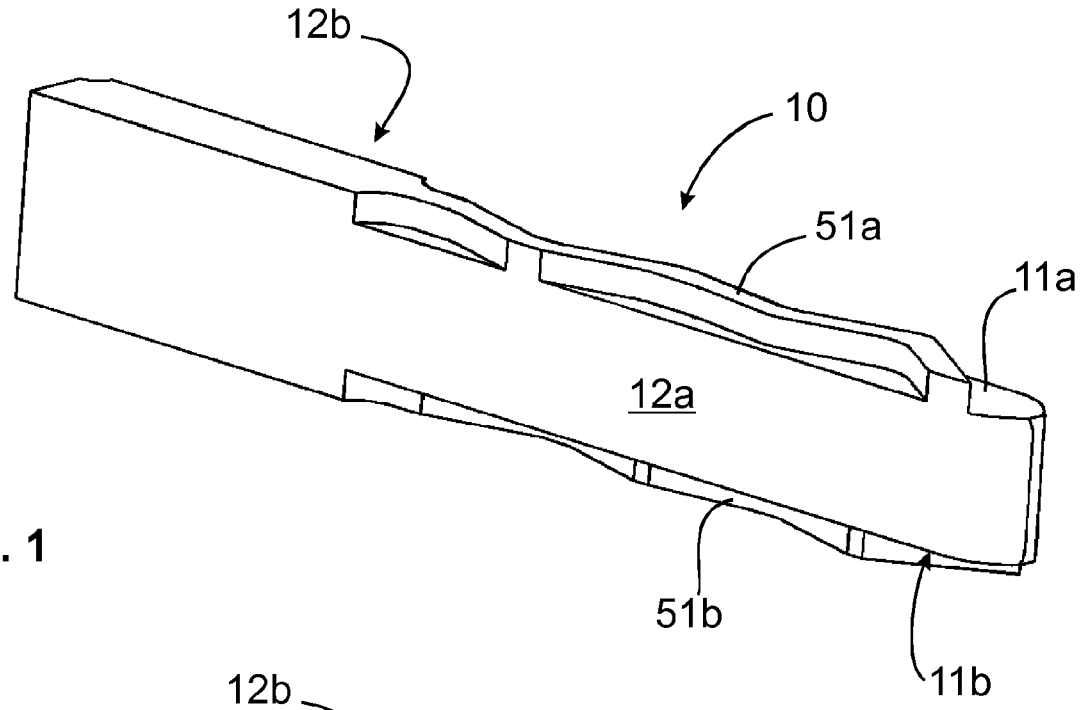
FIG. 1 shows a key of a lock device according to the invention, wherein the key has two coding tracks.

All embodiments according to the figures show a lock device of a motor vehicle, having a key 10 used therewith, and a lock cylinder 1 which is arranged in a vehicle door. The lock cylinder 1 is used in a lock cylinder housing which is not explicitly illustrated, wherein a cylinder core 2 is rotatably mounted inside said lock cylinder housing. The cylinder core 2 has numerous spring-loaded locking elements 30, 40. In addition, the cylinder core 2 is designed with a key channel 3 into which the key 10 can be inserted.

Figure 10A:
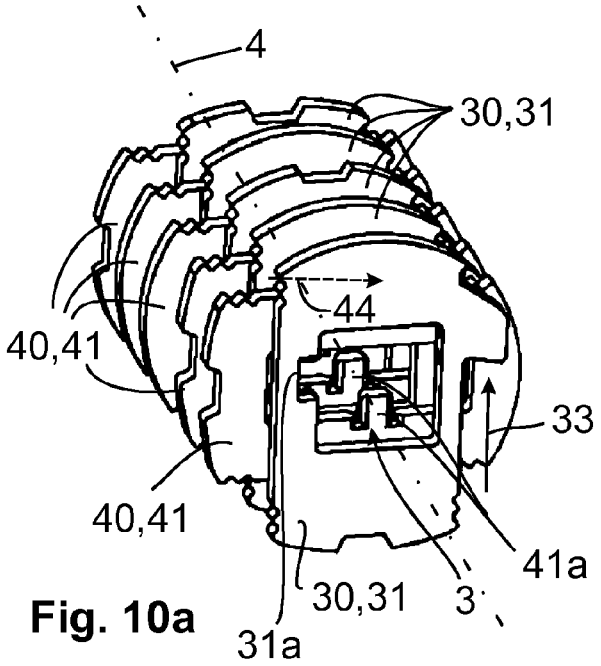
FIG. 10 shows a view of the spring-loaded locking element of a lock cylinder according to the invention.
Figure 10B:
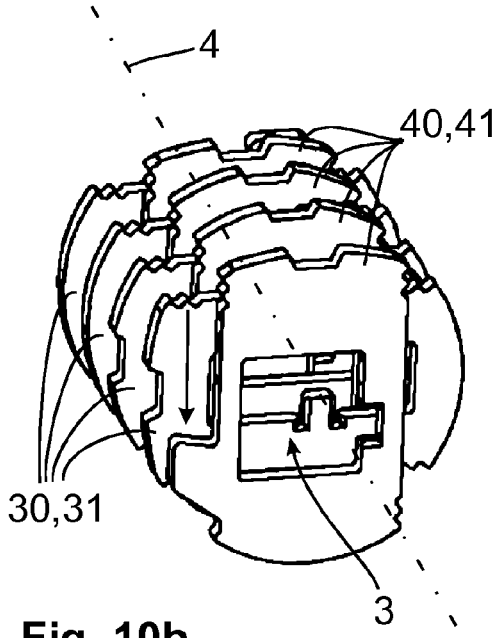
Figure 11:
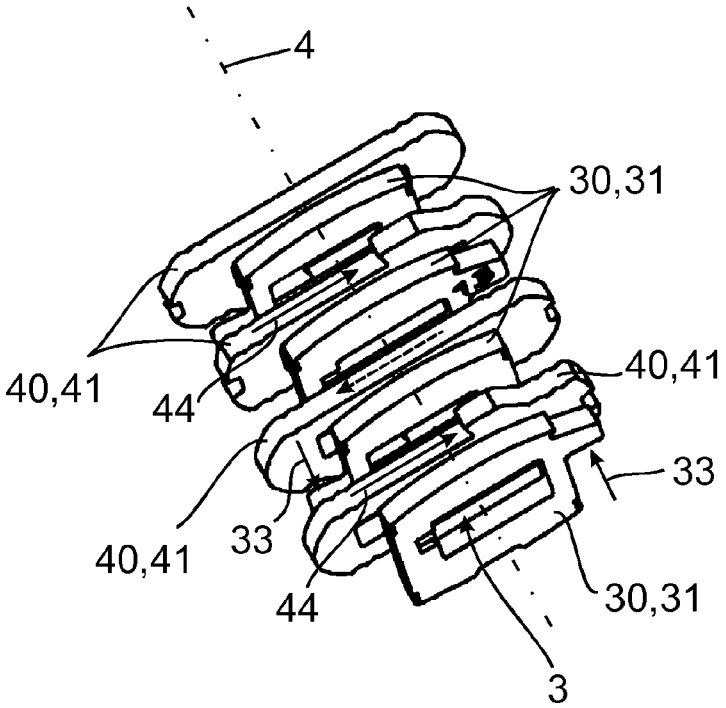
FIG. 11 shows a further view of the locking element in FIG. 10.
Figure 12:
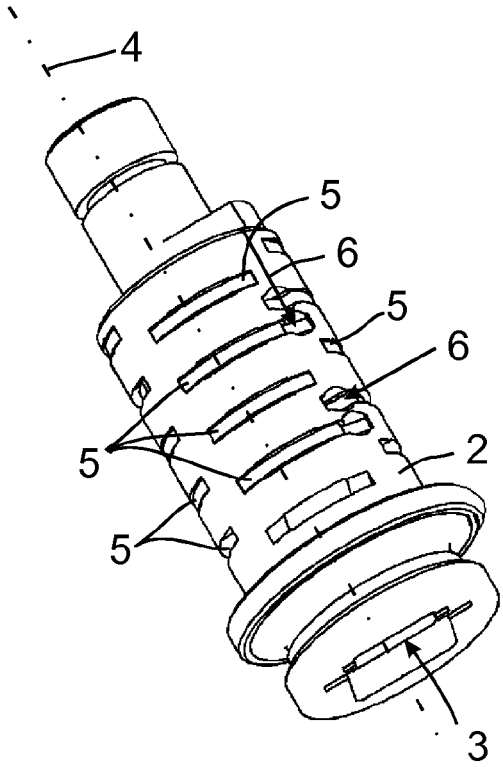
FIG. 12 shows a schematic view of a lock cylinder according to the invention.

As is shown in FIG. 10 and FIG. 11, the lock cylinder 1 according to the invention shown in FIG. 12 has a plurality of locking elements 30, 40. In this case, the locking elements 30, 40 are subdivided into first locking elements 30 and second locking elements 40. The first locking elements 30 have a plurality of individual locking elements 31. The second locking elements 40 likewise have a plurality of individual locking elements 41. The individual locking elements 31 and the individual locking elements 41 are arranged alternating with each other in sequence in the direction of the cylinder axis 4. In addition, the individual locking elements 31 each have a depression and/or recess 31*a*. In contrast, the individual locking elements 41 each have a projection 41*a*. If the key 10 is not inserted inside the channel 3, the locking elements 30, 40 project, along with their respective recesses 31*a* and projections 41*a*, into the channel 3, and simultaneously block a rotation of the cylinder core 2 illustrated in FIG. 12 inside the cylinder housing. In the present case, the locking elements 30, 40 are plate locking elements. These locking elements 30, 40 are displaced upon the introduction of a proper, "correct" key 10 in such a manner that the individual locking elements 31, 41 no longer project from their openings 5 beyond the shell of the cylinder core 2, and the cylinder core 2 can therefore rotate in the cylinder housing. By means of a rotary movement of the inserted key 10, the user is then able to unlock and/or lock an actuating device of the motor vehicle, by means of the lock device according to the invention, according to the direction of the rotation of the key 10. A switch can likewise be actuated by means of the rotation of the key 10, said switch activating and/or deactivating an ignition or voltage, etc. for electronic components of the motor vehicle.

According to all described embodiments, the key 10 has outer surfaces 11*a*, 11*b*, 12*a*, 12*b* which are constructed with at least two coding tracks 50 which act on the locking elements 30, 40 upon the insertion of the key 10 into the channel 3, particularly on the recesses 31*a*, projections 41*a* of the individual locking elements 31, 41. If the "correct" key 10 is inserted inside the channel 3, the locking elements 30, 40 can accordingly be oriented on the cylinder core 2 via the coding tracks 50 such that a rotary movement of the cylinder core 2 is possible.

In one possible embodiment, the key 10 can have two coding tracks 51*a*, 51*b*. The coding tracks 51*a*, 51*b* are each provided on one narrow side 11*a*, 11*b* of the key 10. In contrast, the wide sides 12*a*, 12*b* have no coding.

Figure 2:
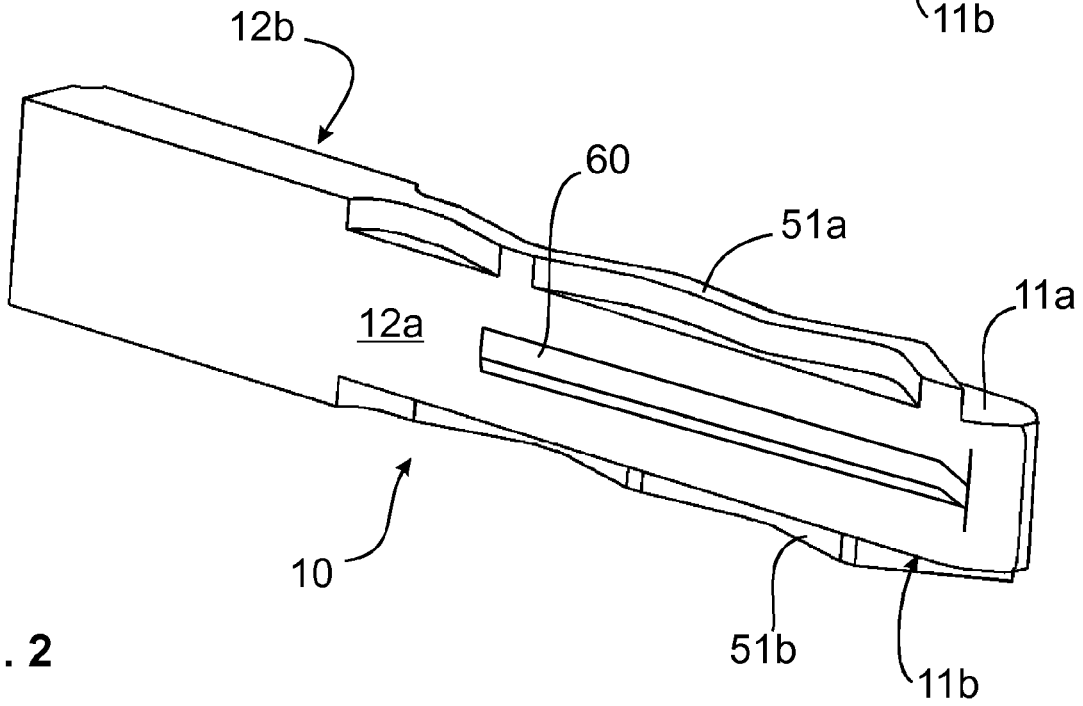
FIG. 2 shows a further key having two coding tracks and one auxiliary coding track, FIGS. 3*a, b* show a further embodiment of a key having two coding tracks.

A further embodiment of a key 10 is shown in FIG. 2, and likewise has two coding tracks 51*a*, 51*b* on its narrow sides 11*a*, 11*b* as in FIG. 1. In addition, the first wide side 12*a* has an auxiliary coding track 60. The auxiliary coding track 60 has a linear extension, with no change of direction. In contrast to the auxiliary coding track 60, the coding tracks 51*a*, 51*b* in FIGS. 1 and FIG. 2 have different coding points. These coding points 51*a*, 51*b* are determined by an individual topography. It can be contemplated that the coding track 51*a* is constructed with a different geometry than the coding track 51*b*. In such a case, the key 10 would not be a reversible key. In the event that the coding track 51*a* is nevertheless laid out symmetrically to the coding track 51*b*, the key 10 in FIG. 1 constitutes a reversible key.

Due to the auxiliary track 60 which is only arranged on the first wide side 12*a*, this key 10 likewise does not constitute a reversible key.

Figure 3A:
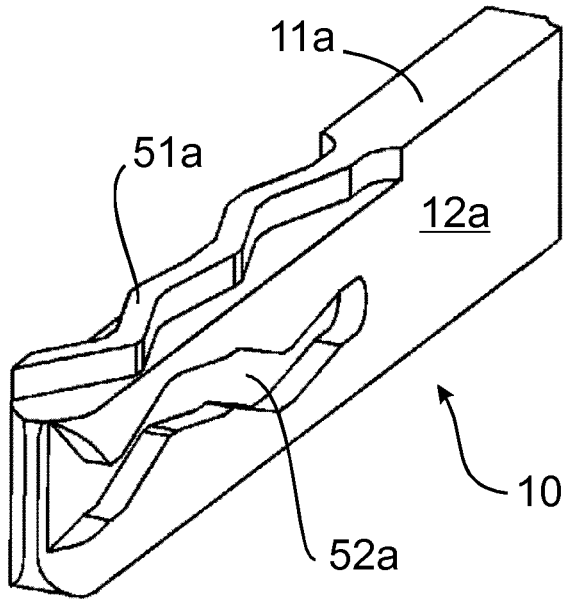
Figure 3B:
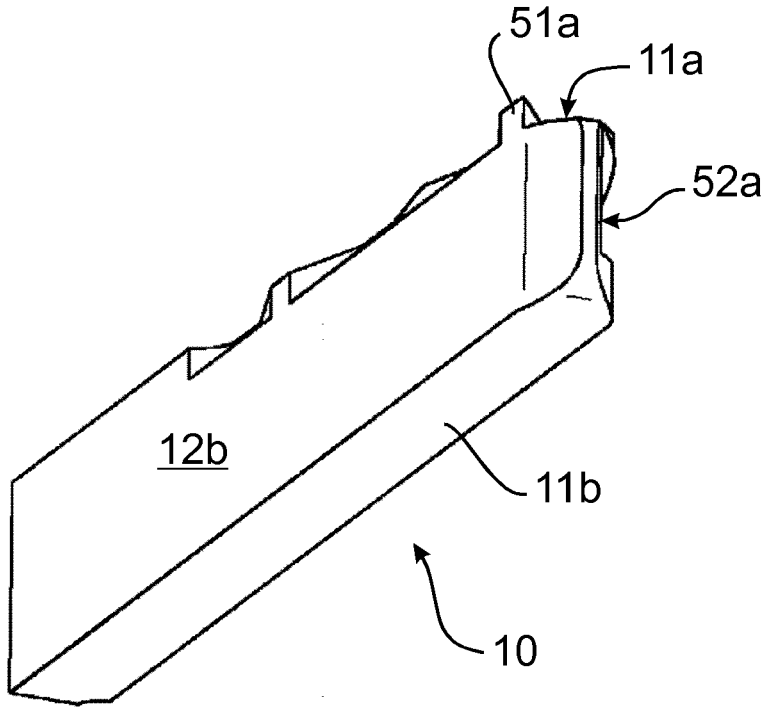

FIG. 3*a* and FIG. 3*b* show a further embodiment variant of a key 10 having two coding tracks 51*a* and 52*a*. In this case, the first narrow side 11*a* of the key 10 has the coding track 51*a*, and the first wide side 12*a* has the additional coding track 52*a*. In contrast to the coding tracks 51*a* on the narrow side 11*a* in FIG. 1 to FIG. 3, the same being designed as a projection-like ridge, the coding track 52*a* of the first wide side 12*a* is designed as a groove-shaped depression. The key 10 in FIGS. 3*a* and 3*b* does not constitute a reversible key.

Figure 4:
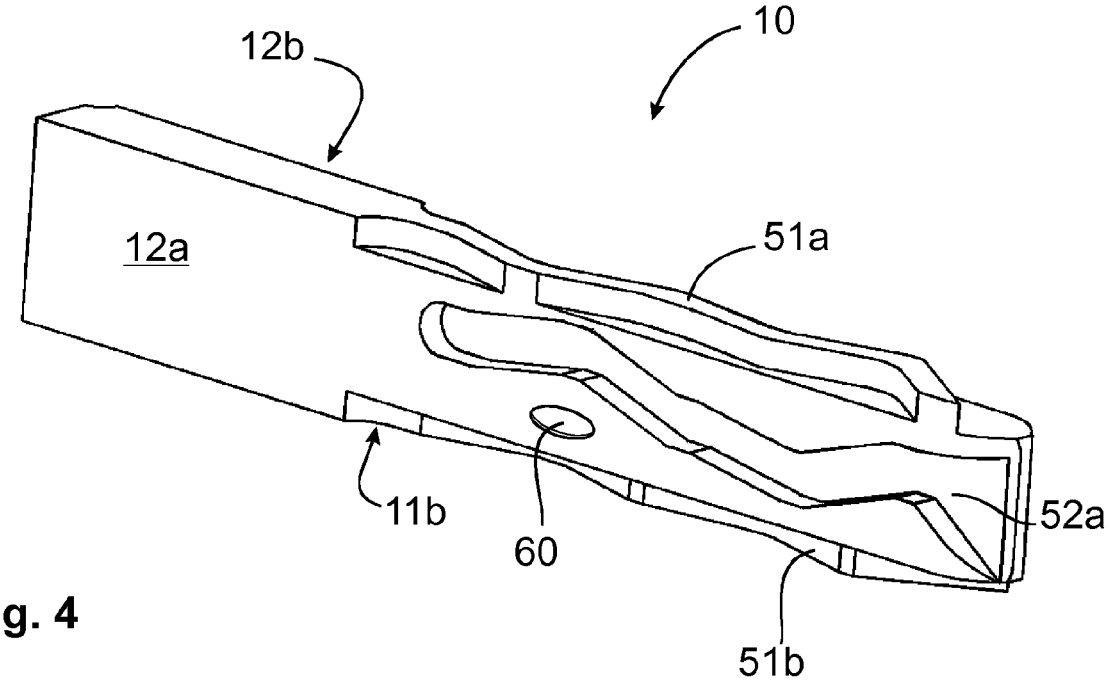
FIG. 4 shows a key according to the invention, having three coding tracks

FIG. 4 illustrates a key 10 having three coding tracks 51*a*, 51*b*, 52*a*. Two coding tracks 51*a*, 51*b* are each included on a narrow side 11*a*, 11*b*. One coding track 52*a* is included on a wide side 12*a*. The opposite wide side 12*b* has no coding track. The recess 60 on the wide side 12*a* can be included in an additional embodiment variant, wherein this recess 60 can serve as an auxiliary coding element.

Figure 5:
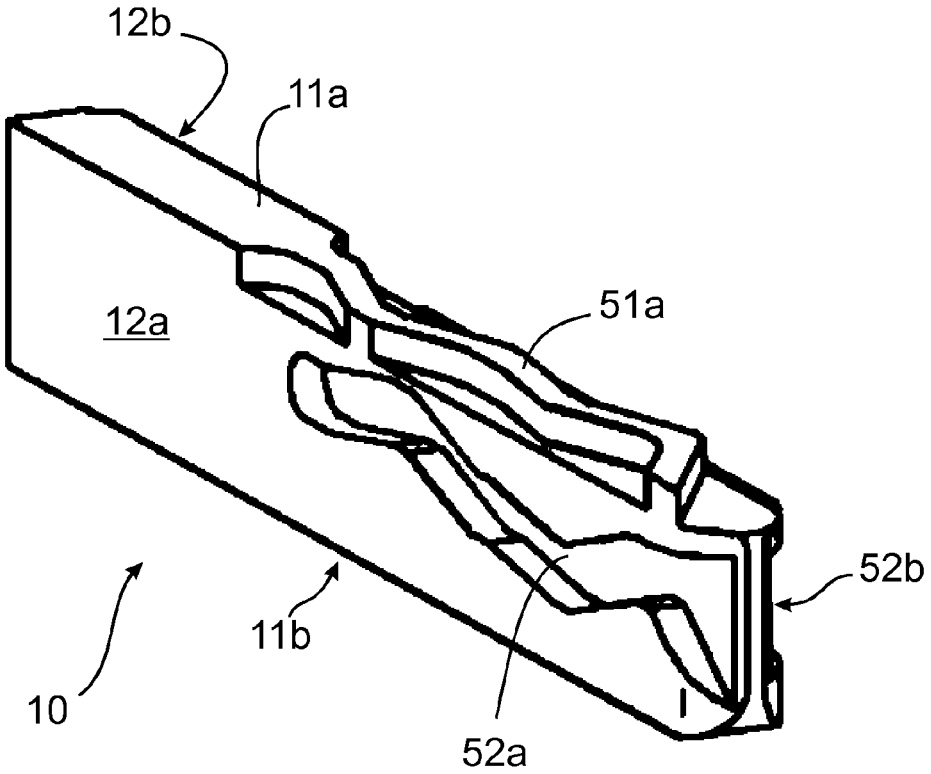
FIG. 5 shows a further embodiment of a key, having three coding tracks.

FIG. 5 also illustrates a key 10 having three coding tracks 51*a*, 52*a*, 52*b*. The essential difference compared to the key 10 in FIG. 4 is that the key 10 in FIG. 5 has a coding track 52*a*, 52*b* on each wide side 12*a*, 12*b*, and only the upper first narrow side 11*a* has a coding track 51*a*. The lower narrow side 11*b* has no coding track. Both keys 10 in FIG. 4 and FIG. 5 constitute vehicle keys which cannot be used as reversible keys.

Figure 6:
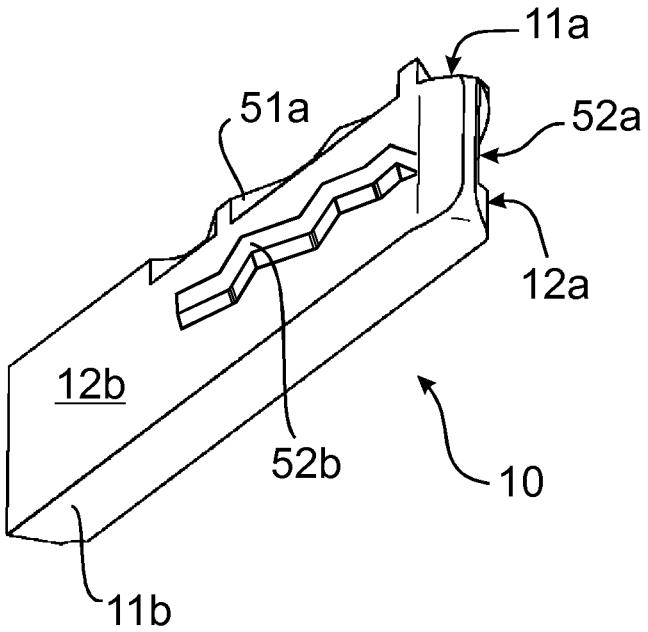
FIG. 6 shows a further key according to the invention, having three coding tracks.

A further embodiment variant of a key 10 is shown in FIG. 6, and likewise has three coding tracks 51*a*, 52*a*, 52*b* on its outer surfaces. The key 10 in FIG. 6 substantially corresponds to the key 10 in FIG. 5, and only the coding track 52*b* is designed differently. In FIG. 6, the coding track 52*b* of the second wide side 12*b* is designed like a projection, projecting from the second wide side, like the coding track 51*a* of the first narrow side 11*a*. This key 10 in FIG. 6 is also not a reversible key.

Figure 7:
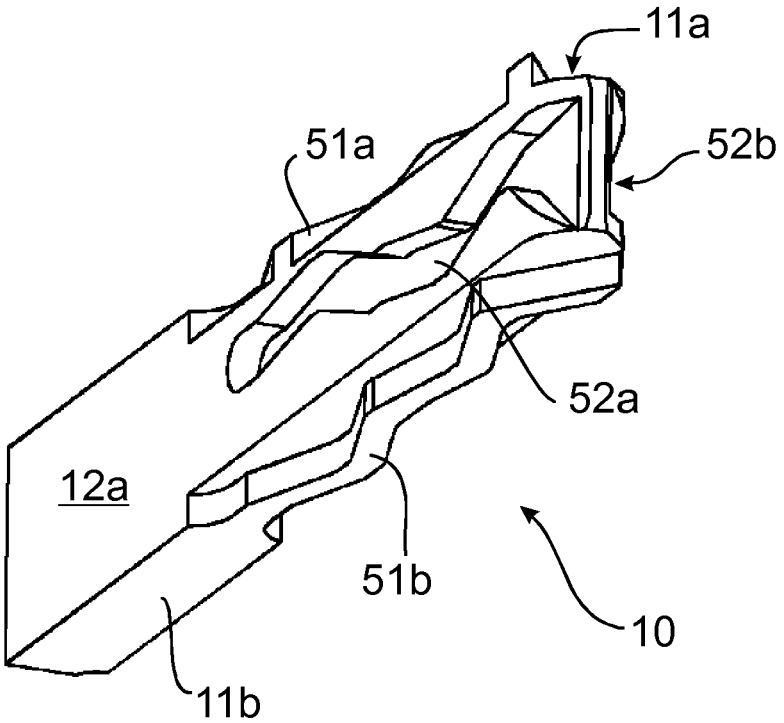
FIG. 7 shows a further key according to the invention, having four coding tracks.

FIG. 7 shows a key 10 having four coding tracks 51*a*, 51*b*, 52*a*, 52*b*. The coding tracks 51*a*, 51*b* of the narrow sides 11*a*, 11*b* are designed as groove-shaped projections. In contrast, the coding tracks 52*a*, 52*b* of the wide sides 12*a*, 12*b* are designed as groove-shaped recesses and/or depressions. The key 10 illustrated in FIG. 7 constitutes a reversible key, because coding tracks 51*a* and 51*b* are arranged symmetrically to each other. In addition, the coding tracks 52*a* and 52*b* are likewise arranged symmetrically to each other. As an alternative, a configuration can be contemplated wherein the geometric layout and profile of the key shown in FIG. 7, with entirely different coding tracks, is designed such that a key with four coding tracks 51*a*, 51*b*, 52*a*, 52*b* is provided which is not a reversible key.

Figure 8:
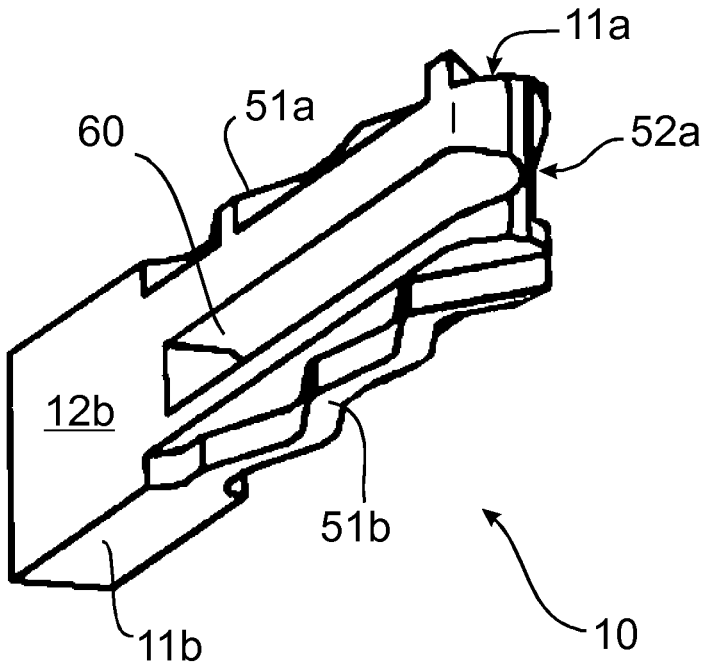
FIG. 8 shows a key according to the invention, having three coding tracks and one auxiliary coding track.

FIG. 8 shows a key 10 with three coding tracks 51*a*, 51*b*, 52*a*. In addition, the second wide side 12*b* has an auxiliary coding track 60 which extends linearly along the layout of the key 10. The additional auxiliary coding track 60 makes it possible to increase the number of code combinations.

Figure 9:
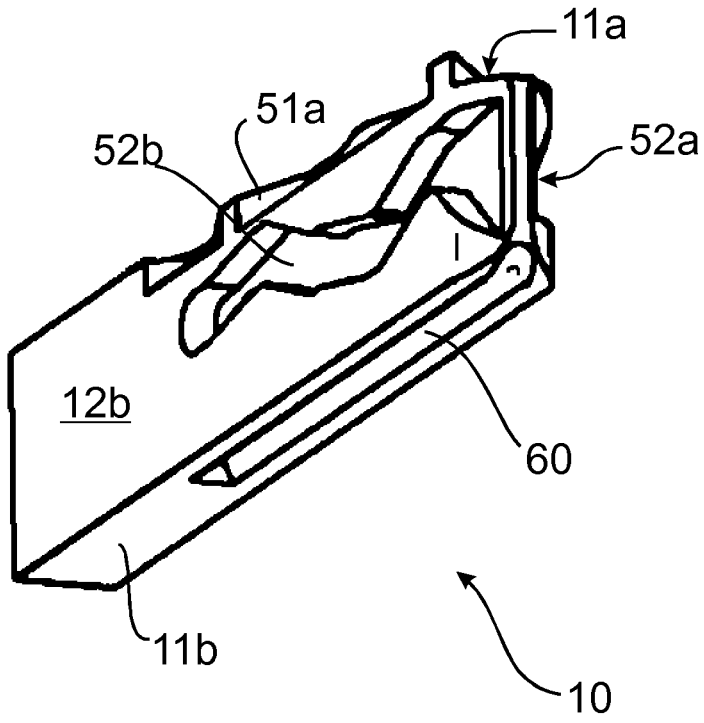
FIG. 9 shows a further key according to the invention, having three coding tracks and one auxiliary coding track.

FIG. 9 shows a further embodiment alternative of a key 10, having three coding tracks 51*a*, 52*a*, 52*b*. In contrast to the embodiment in FIG. 8, the key 10 in FIG. 9 has an auxiliary coding track 60 on the second narrow side 11*b*. This auxiliary coding track 60 likewise runs linearly along the extension of the key 10.

The arrangement of the locking elements 30, 40 is shown schematically in FIG. 10 and FIG. 11. The individual locking elements 31 are arranged along the cylinder axis 4, each alternating with the individual locking elements 41. A spring force 33 acts on the first locking elements 30, acting on a shoulder 34 of the individual locking element 31. A second spring force 44 acts on the second individual locking element 41, and is oriented in the present embodiment perpendicular to the spring force 33. At this point, the same spring force 33 can act in the same orientation on all individual locking elements 31 according to FIG. 10*a*. In order to increase the security against break-ins, the spring force 33 of the first individual locking element 31 can act in a first direction according to FIG. 10*a*. A spring force 33 can act on the following individual locking element 31, said spring force 33 being oriented in the opposite direction to the spring force 33 according to FIG. 10*a*. It can likewise be contemplated that the spring forces 44 acting on the individual locking elements 41 of the locking element 40 are each oriented opposite each other, which is illustrated particularly clearly in FIG. 11.

FIG. 12 shows an example of the cylinder core 2 which is rotatably mounted about the cylinder axis 4. The key 10 can be inserted into the opening and/or the channel 3. When the key 10 is not inserted, the locking elements 30, 40 project out of the slot-shaped openings 5. If the "correct" key 10 is inserted in the cylinder core 2, the locking elements 30, 40 are correspondingly oriented and do not project out of the slot-shaped openings 5 of the shell of the cylinder core 2, such that it is possible for the cylinder core 2 to rotate about the cylinder axis 4. In addition, recesses 6 of the cylinder core 2 are illustrated in FIG. 12, into which spring elements are inserted, wherein the same exert a corresponding spring force in direction 33, 44 on the respective individual locking elements 31, 41 in FIG. 10 to FIG. 11.

Figure 13:
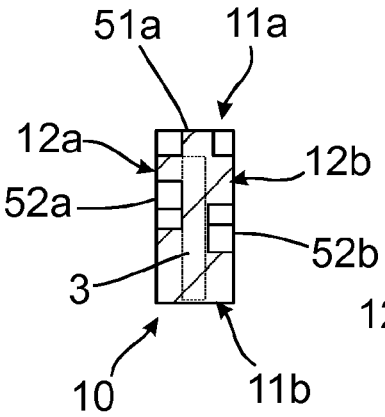
FIG. 13 shows a cutaway view of the key in FIG. 5
Figure 14:
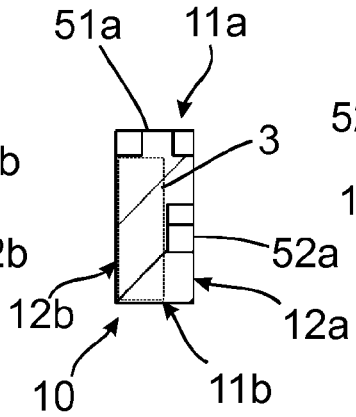
FIG. 14 shows a cutaway view of the key in FIG. 3
Figure 15:
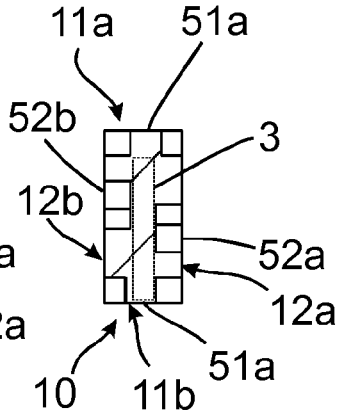
FIG. 15 shows a cutaway view of the key in FIG. 7.

FIG. 13 shows the cross-section surface of the key 10 in FIG. 5. In contrast, FIG. 14 shows the cross-section surface of the key 10 in FIG. 3. FIG. 15 illustrates the cross-section of the key 10 in FIG. 7. All FIGS. 13 to 15 in this case show each of the respective coding tracks 51*a*, 51*b*, 52*a*, 52*b* of the sides 11*a*, 11*b*, 12*a*, 12*b* particularly clearly.

The described embodiments according to FIG. 1 to FIG. 15 can refer to an ID transmitter of a bi-directional security system of a motor vehicle, wherein the key 10 is arranged on the ID transmitter unit. In this case, bi-directional communication is carried out between the ID transmitter and a unit on board a motor vehicle.

The invention claimed is:

1. A lock device of a motor vehicle, having a key and a lock cylinder, wherein the lock cylinder has a cylinder core which is rotatably mounted in a cylinder housing of the lock cylinder, a channel, which is arranged in the cylinder core and into which the key can be inserted, spring-loaded locking elements which are mounted to be able to slide radially with respect to the cylinder axis of the lock cylinder upon the insertion of the key into the channel, multiple planar outer surfaces included on the key which comprise at least two planar coding tracks which act on the locking elements upon the insertion of the key, wherein at least one coding track is designed as a groove and at least one coding track is designed as a ridge, wherein the ridge includes a planar top with at least one perpendicular side surface that undulates.

2. A lock device according to claim 1, wherein the outer surfaces comprise at least one of: two narrow sides; a first and a second narrow side, and two wide sides; and a first and a second wide side.

3. A lock device according to claim 1, wherein the key is designed as a reversible key, such that the key can assume at least two positions in which the key can be functionally inserted into the channel.

4. A lock device according to claim 3, wherein at least both narrow sides and/or both wide sides are each designed with a coding track, wherein the first narrow side is designed with a first coding track and the second narrow side is designed with a second coding track, and/or the first wide side is designed with a first coding track and the second wide side is designed with a second coding track, wherein at least the first coding track of the first narrow side is designed as symmetric to the second coding track of the second narrow side, and/or at least the first coding track of the first wide side is designed as symmetric to the second coding track of the second wide side.

5. A lock device according to claim 1, wherein the outer surfaces of the key have three coding tracks.

6. A lock device according to claim 1, wherein the outer surfaces of the key have four coding tracks.

7. A lock device according to claim 2, wherein the key has two coding tracks, wherein the first and the second wide side each have a coding track, or the first and the second narrow side each have a coding track, or the first wide side and the first narrow side each have a coding track.

8. A lock device according to claim 2, wherein the key has three coding tracks, wherein the first and the second wide side each have a coding track, and the first narrow side has a coding track, or the first and the second narrow side each have a coding track and the first wide side has a coding track.

9. A lock device according to claim 2, wherein the key has four coding tracks, wherein the first and the second wide side each have a coding track, and the first and the second narrow side each have a coding track.

10. A lock device according to claim 1, wherein the coding track has at least one guide surface which acts on associated locking elements, wherein the first coding track acts on first locking elements and the second coding track acts on second locking elements, wherein a displacement of the first locking element occurs in a first radial direction with respect to the cylinder axis, and a displacement of the second locking element occurs in a second radial direction with respect to the cylinder axis, the second radial direction being perpendicular to the first radial direction.

11. A lock device according to claim 10, wherein the first locking elements and the second locking elements are arranged in the cylinder core in an alternating sequence.

12. A lock device according to claim 1, wherein the first locking elements have a plurality of individual locking elements which are each spring-loaded in different directions, and/or the second locking elements have a plurality of individual locking elements which are each spring-loaded in different directions.

13. A lock device according to claim 2, wherein at least one narrow side has a ridge as the coding track and at least one wide side has a groove as the coding track.

14. A lock device according to claim 2, wherein the key has at least one auxiliary coding track which is included on the narrow side and/or on the wide side, which rules out a reversible function of the key.

15. A lock device of a motor vehicle, having a key and a lock cylinder, wherein the lock cylinder has a cylinder core which is rotatably mounted in a cylinder housing of the lock cylinder, a channel, which is arranged in the cylinder core and into which the key can be inserted, spring-loaded locking elements which are mounted to be able to slide radially with respect to the cylinder axis of the lock cylinder upon the insertion of the key into the channel, multiple outer surfaces included on the key which comprise at least two coding tracks which act on the locking elements upon the insertion of the key, wherein at least one coding track is designed as a groove or as a ridge, wherein the ridge is designed in the manner of a projection on the outer surface of the key, wherein each respective locking element engages therein upon the insertion of the key, and wherein the ridge includes a planar top with at least one perpendicular side surface that undulates.

16. A lock device of a motor vehicle, having a key and a lock cylinder, wherein the lock cylinder has a cylinder core which is rotatably mounted in a cylinder housing of the lock cylinder, a channel, which is arranged in the cylinder core and into which the key can be inserted, spring-loaded locking elements which are mounted to be able to slide radially with respect to the cylinder axis of the lock cylinder upon the insertion of the key into the channel, multiple outer surfaces included on the key which comprise at least two coding tracks which act on the locking elements upon the insertion of the key, wherein the outer surfaces comprise at least two narrow sides, wherein the narrow sides are planar, wherein at least one coding track is designed as a ridge, and the ridge includes a planar top with at least one perpendicular side surface that undulates.

* * * * *